US007944148B2

(12) United States Patent
Smith et al.

(10) Patent No.: US 7,944,148 B2
(45) Date of Patent: May 17, 2011

(54) MERCURY FREE TIN HALIDE COMPOSITIONS AND RADIATION SOURCES INCORPORATING SAME

(75) Inventors: David John Smith, Clifton Park, NY (US); Timothy John Sommerer, Ballston Spa, NY (US); Joseph Darryl Michael, Delmar, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 12/241,117

(22) Filed: Sep. 30, 2008

(65) Prior Publication Data

US 2009/0033227 A1 Feb. 5, 2009

Related U.S. Application Data

(63) Continuation-in-part of application No. 11/015,636, filed on Dec. 20, 2004, now Pat. No. 7,847,484, and a continuation-in-part of application No. 11/322,038, filed on Dec. 29, 2005, now abandoned, and a continuation of application No. 11/638,913, filed on Dec. 14, 2006, now Pat. No. 7,825,598.

(51) Int. Cl.
*H01J 61/18* (2006.01)
*H01K 1/50* (2006.01)

(52) U.S. Cl. ..... 313/638; 313/579

(58) Field of Classification Search ..... None
See application file for complete search history.

(56) References Cited

U.S. PATENT DOCUMENTS

| | | | | |
|---|---|---|---|---|
| 3,882,345 | A | 5/1975 | Kazek et al. | |
| 4,065,694 | A * | 12/1977 | Kulkarni | 313/579 |
| 4,078,188 | A * | 3/1978 | Martin et al. | 313/579 |
| 5,866,984 | A * | 2/1999 | Doughty et al. | 313/643 |
| 6,069,456 | A * | 5/2000 | Fromm et al. | 315/248 |
| 6,633,111 | B1 | 10/2003 | Kim et al. | |
| 7,265,493 | B2 | 9/2007 | Sommerer et al. | |
| 2005/0242737 | A1 | 11/2005 | Scholl et al. | |
| 2006/0071602 | A1 | 4/2006 | Sommerer et al. | |
| 2006/0132042 | A1 | 6/2006 | Smith et al. | |
| 2006/0132043 | A1 | 6/2006 | Srivastava et al. | |
| 2007/0096656 | A1 | 5/2007 | Smith et al. | |

FOREIGN PATENT DOCUMENTS

| | | | |
|---|---|---|---|
| GB | 1533270 | A | 11/1978 |
| WO | WO2004025688 | A2 | 3/2004 |

OTHER PUBLICATIONS

M.Sugiura; Review of metal-halide discharge-lamp development 1980-1992; Light Sources; Feb. 13, 2006; pp. 443-449; vol: 140, issue: 6.

* cited by examiner

*Primary Examiner* — Toan Ton
*Assistant Examiner* — Britt D Hanley
(74) *Attorney, Agent, or Firm* — Mary Louise Gioeni

(57) ABSTRACT

A radiation source is presented, the source comprising an ionizable mercury-free composition that comprises tin halide such that the halide to tin ratio is greater than 2.

13 Claims, 2 Drawing Sheets

MERCURY FREE TIN HALIDE COMPOSITIONS AND RADIATION SOURCES INCORPORATING SAME

CROSS REFERENCE TO RELATED APPLICATIONS

This application is a continuation in part of following U.S. patent applications:

Ser. No. 11/015,636, entitled "MERCURY-FREE AND SODIUM-FREE COMPOSITIONS AND RADIATION SOURCES INCORPORATING SAME", filed on Dec. 20, 2004;

Ser. No. 11/322,038, entitled "MERCURY-FREE DISCHARGE COMPOSITIONS AND LAMPS INCORPORATING GALLIUM" filed on Dec. 29, 2005; and Ser. No. 11/638,913, entitled "MERCURY-FREE DISCHARGE COMPOSITIONS AND LAMPS INCORPORATING TITANIUM, ZIRCONIUM, AND HAFNIUM" filed on Dec. 14, 2006, which are herein incorporated by reference.

BACKGROUND

The present invention relates generally to a mercury-free composition capable of emitting radiation if excited. In particular, the invention relates to a radiation source comprising an ionizable composition being capable of emitting radiation if excited.

Ionizable compositions are used in discharge sources. In a discharge radiation source, radiation is produced by an electric discharge in a medium. The discharge medium is usually in the gas or vapor phase and is preferably contained in a housing capable of transmitting the radiation generated out of the housing. The discharge medium is usually ionized by applying an electric field created by applying a voltage across a pair of electrodes placed across the medium. Radiation generation occurs in gaseous discharges when energetic charged particles, such as electrons and ions, collide with gas atoms or molecules in the discharge medium, causing atoms and molecules to be ionized or excited. A significant part of the excitation energy is converted to radiation when these atoms and molecules relax to a lower energy state, and in the process emit the radiation.

Gas discharge radiation sources are available and operate in a range of internal pressures. At one end of the pressure range, the chemical species responsible for the emission is present in very small quantities, generating a pressure during operation of a few hundreds of Pascals or less. The radiating chemical species may sometimes constitute as little as 0.1% of the total pressure.

Gas discharge radiation sources having a total operating pressure at the low end of the pressure range and radiating at least partly in the UV spectrum range can convert UV radiation to visible radiation via the use of appropriate phosphors, which can absorb the UV radiation and emit visible light through the process of fluorescence; hence such sources are often referred to as fluorescent sources. The color properties of fluorescent sources are determined by the phosphors used to coat the tube. A mixture of phosphors is usually used to produce a desired color appearance.

Other gas discharge sources, including high intensity discharge sources, operate at relatively higher pressures (from about 0.05 MPa to about 20 MPa) and relatively high temperatures (higher than about 600° C.). These discharge sources usually contain an inner arc tube enclosed within an outer envelope.

Many commonly used discharge radiation sources contain mercury as a component of the ionizable composition. Disposal of such mercury-containing radiation sources is potentially harmful to the environment. Therefore, it is desirable to provide mercury-free discharge compositions capable of emitting radiation, for use in radiation sources and other applications.

SUMMARY OF INVENTION

In general, the present invention provides ionizable mercury-free compositions that are capable of emitting radiation when excited and radiation sources that incorporate one of such compositions.

One aspect of the invention is a radiation source. The said radiation source comprises an ionizable mercury-free composition that comprises tin halide such that the halide to tin ratio is greater than 2.

Another aspect of the invention is a radiation source comprising an ionizable mercury-free composition that comprises tin iodide such that iodine to tin ratio is about 4, operates at a temperature less than about 150° C., with the vapor pressure of tin during an operation less than about 100 Pa, and comprises argon as a buffer gas with pressure in a range from about 100 Pa to about $1\times10^4$ Pa during the said operation of the radiation source.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

As discussed in detail below, embodiments of the present invention include mercury-free discharge compositions and radiation sources that incorporate such compositions.

The terms 'discharge lamp' and 'radiation source' may be used interchangeably herein. The radiation source can be in several forms including a fluorescent lamp, an excimer lamp, a flat fluorescent lamp, a miniature gas laser or the like.

Figure 1:
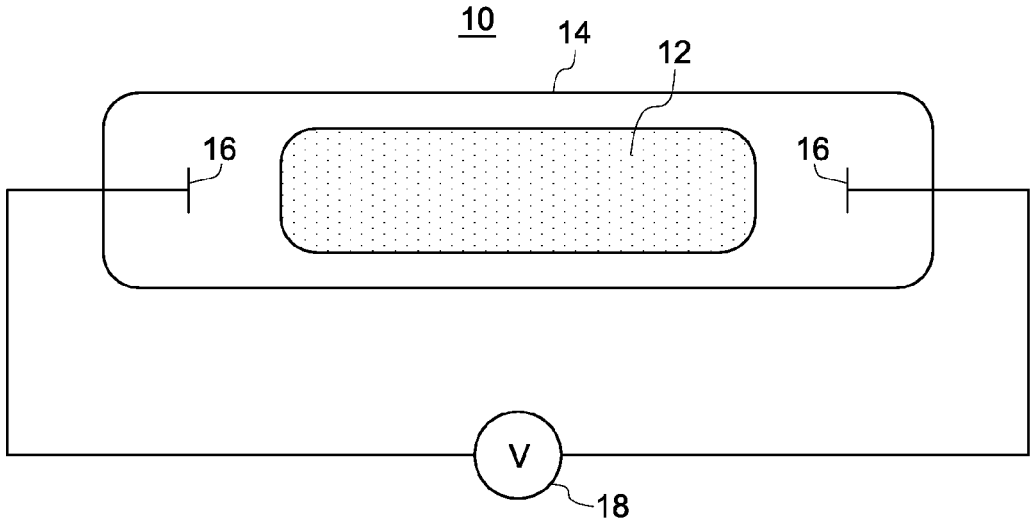
FIG. 1 is a radiation source in accordance with one embodiment of the present invention.

FIG. 1 schematically illustrates a gas discharge radiation source 10 according to one embodiment. FIG. 1 shows a tubular housing or vessel containing an ionizable composition 12 of the present invention. The housing comprises an envelope 14, electrodes 16, and a voltage source 18.

Mercury-based ionizable discharge compositions are extensively used in radiation sources such as discharge lamps due to the high efficiency of the discharge compositions in generating radiation. However, due to potential health concerns associated with mercury exposure, increasing efforts have been directed towards development of mercury-free discharge compositions. More specifically, research efforts have focused on identification and development of a mercury-free discharge composition having an equally efficient or more efficient discharge as compared to that of mercury-containing compositions. However, finding a mercury-free discharge composition with good efficiency has proven to be a very challenging task.

In accordance with aspects of the present invention, it has been determined that tin halide based ionization compositions show good efficiency and are suitable for use as a mercury-free discharge composition in radiation sources. The details of such mercury-free discharge compositions, and optimization details are described in the subsequent embodiments.

In accordance with one aspect of the invention, a mercury-free discharge composition capable of emitting radiation when excited is provided. In one embodiment, the mercury-free discharge composition includes a tin halide such that the halogen to tin ratio is greater than 2. In another embodiment the composition includes a tin halide such that the halogen to tin ratio is in between 2-4. In yet another embodiment the halogen to tin ratio is around 4.

Suitable examples of the halogen included in the halide include chlorine, bromine, iodine, or combinations of these materials. Accordingly, in one embodiment, the mercury-free discharge composition includes tin iodide. In another embodiment, the mercury-free discharge composition includes tin chloride, while in yet another embodiment, the mercury-free discharge composition includes tin bromide. In one embodiment, the mercury-free discharge composition includes a mixture of two or more tin halides, or a mixture of elemental tin and a tin halide. In one embodiment, the ionizable mercury-free discharge composition is sodium-free.

As mentioned above, the mercury-free discharge composition may be capable of emitting radiation when excited. Upon excitation, the mercury-free discharge material may dissociate and form into different species depending on the energy available for the reactions. The different species may include ions, atoms, electrons, molecules or any other free radicals. At any given instant during discharge, the discharge composition may be a combination of these species. For example, in a mercury-free discharge composition including tin and iodine, upon excitation, the discharge composition may include a mixture of metallic tin, tin ions, iodine ions, tin iodide ions, electrons, various neutral and charged species containing tin and iodine, and various combinations of these species. The amount of each of these species may depend on the amount of discharge material, internal pressure, and temperature during operation. These dissociation/formation reactions may be reversible and can occur constantly or otherwise repeatedly under steady state conditions. Thus the emission spectra from the emitted radiation of the mercury-free discharge composition may be tuned and hence optimized for increased efficiency by changing one or more characteristics of the discharge lamp. For example, the amount of discharge material introduced into the envelope of the discharge lamp could be changed, the pressure within the discharge envelope could be changed, and the temperature of the discharge composition during discharge could be changed. Apart from these parameters, various other factors such as the current density, lamp diameter and length, getters, complexing additives, and other parameters may be tuned to optimize the efficiency of the discharge.

As noted above, optimizing the discharge composition through e.g., adjustment of the internal pressure of the discharge envelope, the amount of discharge material within the envelope, and temperature of the discharge composition may improve the efficiency of discharge radiation during operation. Such optimization may be effected by controlling the partial pressure of tin and its compounds present within the discharge composition, or by controlling the pressure of the inert buffer gas, or both together. Often, the efficiency of the discharge composition is measured by its luminous efficacy. The luminous efficacy, expressed in Lumen/Watt, is the ratio between the brightness of the radiation in a specific visible wavelength range and the energy used to generate the radiation.

It has been determined by the inventors that an increase in the luminous efficacy of a device incorporating the mercury-free discharge composition described herein can be achieved by controlling the operating temperature of the discharge separately or along with controlling the ratio of halogen to tin. Especially in low-pressure discharge lamps, the tin halide discharge plasma is found to have two operating regions of high luminous efficacy, governed by the molar ratio of halogen to tin and the operating temperature. One is the highest efficacy (>30%) regime, having an operating temperature greater than about 300° C. and the molar ratio of halogen to tin in the discharge composition equal to or less than 2. The other high efficacy region, in which the luminous efficacy can be about 25-30%, is where the operating temperature is less than 170° C. and the halogen to tin molar ratios are greater than 2. As used herein the 'operating temperature' or 'temperature of operation' is defined as the coldest temperature of the lamp wall in direct contact with the discharge which influences the $SnI_4$ vapor pressure. As mentioned earlier, these efficiencies can be further enhanced by optimizing other parameters such as pressure, surrounding gas type, dose mass etc.

Figure 2:
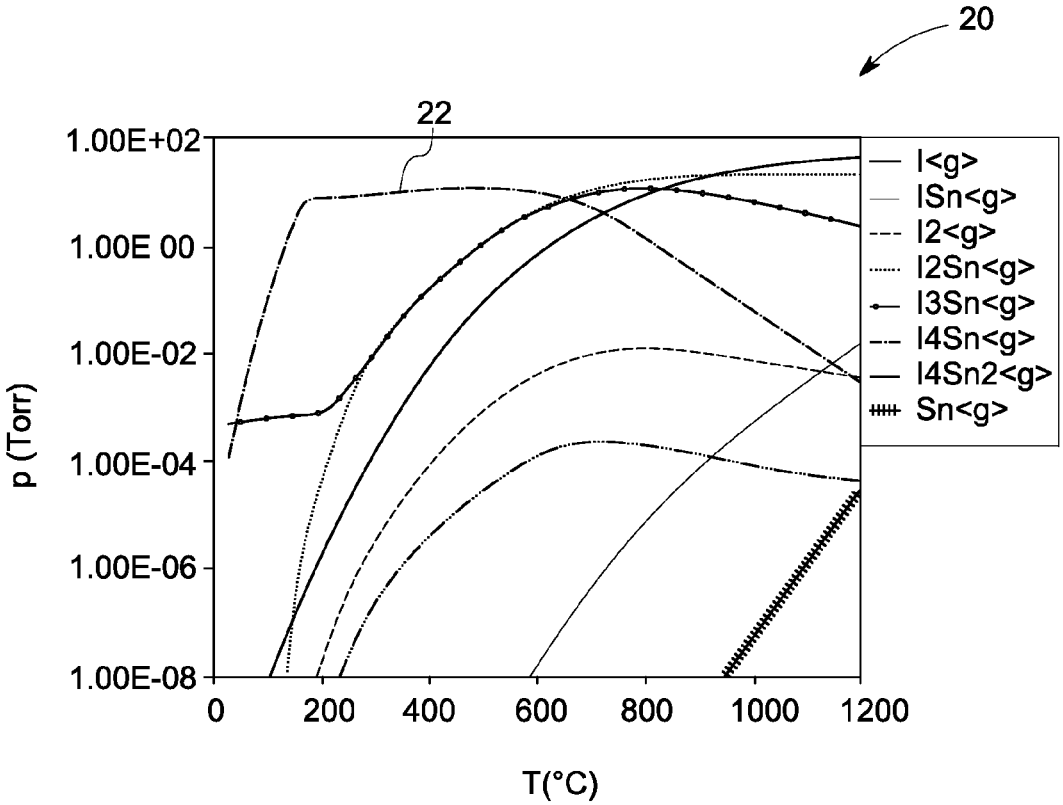
FIG. 2 is a plot of vapor pressures of different constituents with respect to temperature when the Sn:I ratio is 1:4 according to one embodiment of the present invention.

FIG. 2 illustrates plot 20 of thermochemically calculated variation of vapor pressures of Sn, I and different combinations of Sn and I with respect to temperature when iodine to tin ratio in an enclosure is 4:1. The curve 22 represents the $SnI_4$ vapor pressure among the other curves as indicated. Curve 22 shows a sharp vapor pressure increase at relatively low temperatures compared to other gaseous entities indicating that there is an appreciable vapor pressure even below 150° C. temperature. Hence in this temperature range $SnI_4$ can substantially evaporate, dissociate, get excited and radiate.

Figure 3:
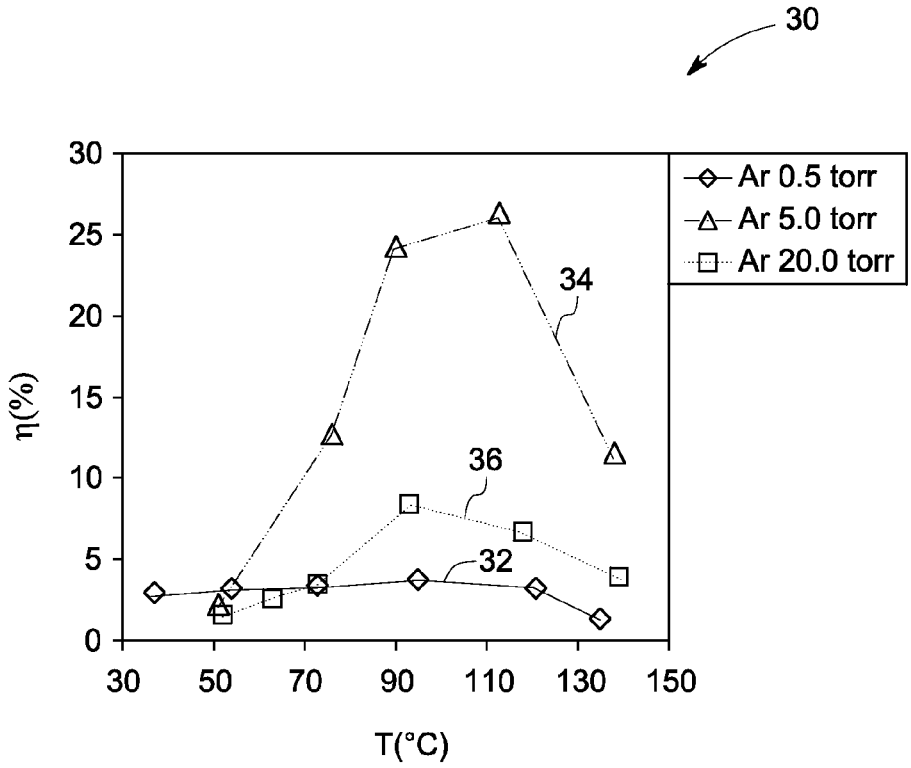
FIG. 3 is a plot of discharge efficiency versus operating temperature for different mercury-free discharge compositions, according to one embodiment of the present invention.

FIG. 3 illustrates the plot 30 of variation of efficiency for $SnI_4$ versus temperature according to one embodiment of the invention. In FIG. 3, the efficiencies during operation have been plotted against temperature for three buffer gas pressures, measured at room temperature, of 0.5 torr (67 Pa) 32, 5.0 torr (670 Pa) 34, and 20.0 torr (2700 Pa) 36. The plot indicates that tin iodide based discharge composition shows high efficiency at temperatures between about 50° C. to about 150° C. with a peak around 100° C. The data for 670 Pascals shows the highest efficiency in this case.

The mercury free radiation sources or lamps operating at low temperatures and low pressures will be very useful for a number of applications. For instance, the low temperature operating lamps may be a desirable retrofit replacement of mercury containing radiation sources for fluorescent lamps and other products. Here the lamp wall or envelope can be closer to ambient temperature during the lamp operation. Lamps that operate near room temperature generally come to full brightness faster and require less thermal management and protection than lamps that operate at elevated temperatures Hence the operational cost of the near room temperature lamps will also be lower than the lamps operating at higher temperatures.

The mercury-free discharge composition may further include an inert buffer gas. The inert buffer gas may include helium, neon, argon, krypton, xenon, or combinations thereof. The inert buffer gas may enable or otherwise facilitate the gas discharge to be more readily ignited. The inert buffer gas can also control the steady state operation of the radiation source, and may further be used to optimize operation of the radiation source. In a non-limiting example, argon can be used as the inert buffer gas. However, argon may be substituted or supplemented with one or more other inert gasses, such as helium, neon, krypton, xenon, or combinations thereof.

In one embodiment, the mercury-free discharge composition produces a total equilibrium operating pressure of less than about 10,000 Pascals when excited. In another embodiment, the composition produces a total equilibrium operating pressure of less than about 2,000 Pascals when excited. In one embodiment, the mercury-free discharge lamp has a total equilibrium operating pressure in the range from about 150 Pa to about 1500 Pa.

The housing of a radiation source can have a circular or non-circular cross section, and need not be straight. The material comprising the envelope of the housing may be transparent, semi transparent or opaque. In one embodiment, the envelope is a substantially transparent material. The term "substantially transparent" means allowing a total transmission of at least about 50 percent of the incident radiation within about 10 degrees of a perpendicular to a tangent drawn at any point on the surface of the envelope. In another embodiment the transmission can be greater than about 75 percent, and in yet another embodiment, the transmission can be greater than about 90 percent. In one embodiment the discharge can be excited by thermionically emitting electrodes using a voltage source. The discharge may also be generated by other methods of excitation that provide energy to the composition. It is within the scope of this invention that various waveforms of voltage and current, including alternating or direct, are contemplated for the present invention. It is also within the scope of this invention that additional voltage sources may also be present to help maintain the electrodes at a temperature sufficient for thermionic emission of electrons.

A phosphor composition may be coated on the inner surface of the envelope 14. Alternatively, the phosphor composition can be applied to the outside of the radiation source envelope provided that the envelope is not made of any material that absorbs a significant amount of the radiation emitted by the discharge. A suitable material for this embodiment is quartz, which absorbs little radiation in the UV spectrum range. Alternatively, certain glasses are known in the art to be suitable for these applications. The phosphor layer coatings in discharge lamps may be formed by various procedures including deposition from liquid suspensions and electrostatic deposition. For example, the phosphor may be deposited on the envelope surface from an aqueous suspension including various organic binders and adhesion promoting agents. The aqueous suspension may be applied and then dried.

In one embodiment of the radiation source, the housing containing the ionizable composition has an inner envelope and an outer envelope. The space between the two envelopes may be either evacuated or filled with a gas. In such embodiments a phosphor composition can be coated on the outer surface of the inner envelope and/or the inner surface of the outer envelope. The evacuated space between the envelopes ensures that the phosphor composition is not exposed to high temperature during operation. The double walled envelope may be used to thermally insulate the inner tube to allow it to maintain the desired operating temperature with lower input power density. The mercury-free discharge lamp envelope alternatively may be embodied so as to be a multiple-bent tube with inner envelope surrounded by an outer envelope or bulb.

In accordance with one aspect of the present invention, a discharge lamp is provided with a discharge mechanism configured to generate and maintain a gas discharge. For example, the discharge lamp can include electrodes disposed at two points of a discharge lamp housing and a current source providing a current to the electrodes. In one embodiment, the electrodes are hermetically sealed within the envelope. In another embodiment, the discharge lamp is electrodeless. In another embodiment of an electrodeless discharge lamp, the discharge mechanism includes emitter of an electromagnetic radiation, for example radio frequency, present outside or inside the envelope containing the ionizable composition. In still another embodiment of the present invention, the ionizable composition is capacitively excited with a high frequency field, the electrodes being provided on the outside of the gas discharge vessel. In still another embodiment of the present invention, the ionizable composition is inductively excited using a high frequency field.

Mercury-free metal halide based discharge compositions described herein have spectral transitions at different wavelengths than that of the mercury-based discharge compositions. In accordance with another aspect of the invention, phosphor compositions are provided that are suitable for use in radiation sources such as a discharge lamp incorporating the ionizable mercury-free metal halide discharge composition described herein. In one embodiment, the phosphor compositions can be placed in communication with the discharge composition to absorb at least a portion of the radiation emitted by the discharge composition at one wavelength and to emit radiation of a different wavelength. The chemical composition of the phosphor may determine the spectrum of the radiation emitted. In particular, a phosphor composition used in a discharge lamp incorporating the tin halide discharge composition is configured to absorb radiation in the UV and visible ranges and emit in the visible wavelength ranges, such as in the red, blue and green wavelength range, and enable a high fluorescence quantum yield to be achieved.

Figure 4:
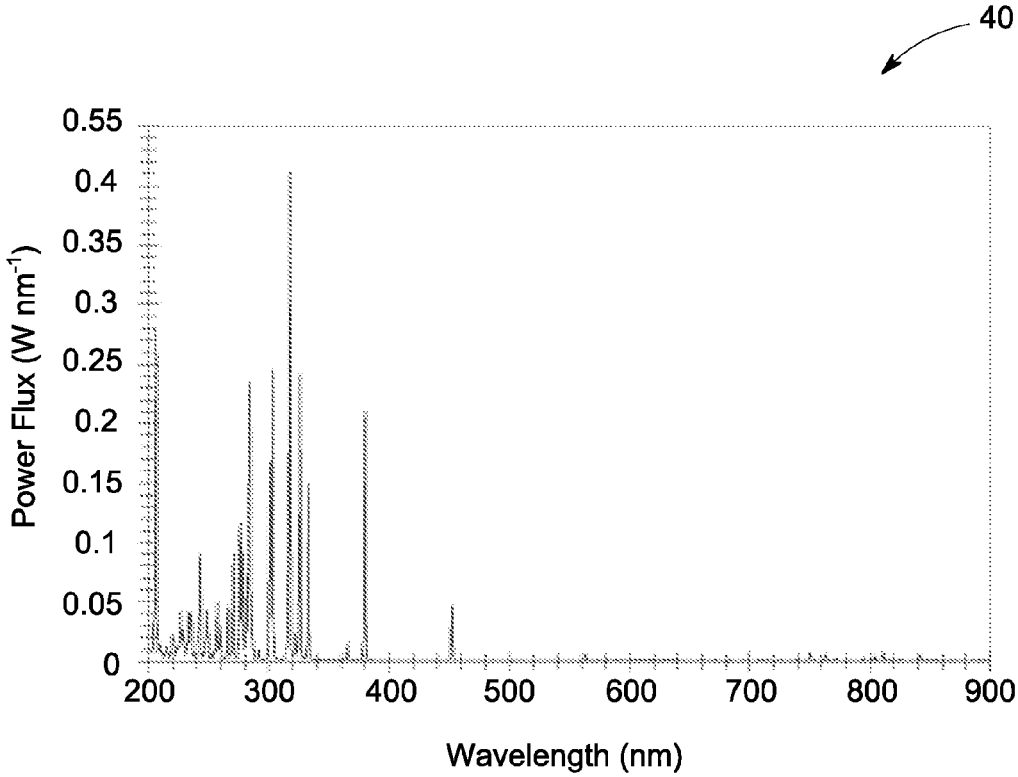
FIG. 4 is an emission spectrum of $SnI_4$ in Ar according to one embodiment of the invention.

In a non-limiting example, a gas discharge radiation source containing tin and tin iodide produces a radiation output that is dominantly composed of multiple spectral transitions in the UV region between about 240 nanometers to about 400 nanometers, as shown in the plot 40 of FIG. 4. This exemplary embodiment uses phosphors that convert radiation of at least one of the wavelengths in this range and emits in the visible spectrum.

In one embodiment of this invention, the discharge composition comprises any of the stable halides of tin, for example, $SnI_4$, mixed with an amount of Sn, resulting in a iodine to tin molar ratio of less than the stoichiometric ratio (4:1) in this case. In another embodiment, the discharge composition comprises a mixture of elemental metal tin and elemental halogen.

In one embodiment, a phosphor composition used in a discharge lamp incorporating the tin iodide discharge composition includes a phosphor blend of at least one red emitting phosphor, a green emitting phosphor, and a blue emitting phosphor. When the phosphor composition includes a blend of two or more phosphors, the ratio of each of the individual phosphors in the phosphor blend can vary depending on the characteristics of the desired light output. The composition and the ratio of the red, green, and blue emitting phosphors can be chosen to obtain maximum light output at the desired wavelength range, high temperature stability, and high color rendition. The relative proportions of the individual phosphors in the various embodiment phosphor blends may be adjusted such that their emissions are blended to give a desired color. In one embodiment, the blend is chosen to produce a white light. In one embodiment, the phosphor composition used in the discharge lamp includes a phosphor blend of at least one phosphor that absorbs in UV.

EXAMPLE

A cylindrical quartz discharge vessel, which is transparent to UV-A radiation, 14 inches in length and 1 inch in diameter, was provided. The discharge vessel was evacuated and a dose of 10.0 mg $SnI_4$ and argon were added. The pressure of argon was about 267 Pascals at ambient temperature. The vessel was inserted into a furnace and power was capacitively-coupled into the gas medium via external copper electrodes at an excitation frequency of 13.56 MHz. Radiative emission and radiant efficiency were measured. The ultraviolet and visible output power was estimated to be about 26 percent of the input electrical power at a power density of 200 $mW/cm^3$ and a temperature of about 113° C. When the ultraviolet radiation is converted to visible light by a suitable phosphor blend, the luminous efficacy was estimated to be 55 lumens per watt.

While various embodiments are described herein, it will be appreciated from the specification that various combinations of elements, variations, equivalents, or improvements therein are foreseeable, may be made by those skilled in the art, and are still within the scope of the invention as defined in the appended claims.

The invention claimed is:

1. A method of operating a radiation source, comprising:

providing an ionizable mercury-free composition that comprises tin iodide such that iodine to tin ratio is greater than 2;

providing an inert buffer gas;

operating at a temperature less than about 170° C.;

operating at the inert buffer gas pressure range from about 100 Pa to about $1\times10^4$ Pa; and operating at a vapor pressure of tin less than about 100 Pa.

2. The method of claim 1, wherein the iodine to tin ratio is in the range greater than 2 to about 4.

3. The method of claim 1, wherein the iodine to tin ratio is about 4.

4. The method of claim 1, wherein said inert buffer gas is selected from the group of helium, neon, argon, krypton, xenon, and combinations thereof.

5. The method of claim 4, wherein said inert buffer gas comprises argon.

6. The method of claim 1, wherein the radiation source is operated at the inert buffer gas pressure in a range from about 150 Pa to about 1500 Pa.

7. The method of claim 1, wherein the radiation source further comprises a housing containing said ionizable composition; and said housing comprises at least one envelope.

8. The method of claim 7, wherein the radiation source further comprises a phosphor coating applied to at least one surface of said at least one envelope.

9. The method of claim 8, wherein the radiation source further comprises electrodes disposed in said housing.

10. The method of claim 9, wherein the radiation source further comprises a power source electrically coupled to the electrodes.

11. The method of claim 1, wherein the radiation source is provided with a means for generating and maintaining a gas discharge.

12. The method of claim 11, wherein a gas discharge in said radiation source is initiated with a current flow through said means.

13. The method of claim 11, wherein a gas discharge in said radiation source is initiated with a radio frequency.

* * * * *